US005638907A

United States Patent [19]

Salmonsen et al.

[11] Patent Number: 5,638,907

[45] Date of Patent: Jun. 17, 1997

[54] FIRE EXTINGUISHER CABINET MOUNTING

[75] Inventors: Gregory C. Salmonsen; Arthur D. Hogate, both of Owatonna, Minn.

[73] Assignee: Technico, Inc., Owatonna, Minn.

[21] Appl. No.: 604,113

[22] Filed: Feb. 20, 1996

[51] Int. Cl.[6] ..... A62C 35/20

[52] U.S. Cl. ..... 169/51; 312/242; 312/409; 52/36.4; 52/317

[58] Field of Search ..... 169/51; 312/409, 312/242; 52/317, 36.4

[56] References Cited

U.S. PATENT DOCUMENTS

| | | |
|---|---|---|
| 1,543,349 | 6/1925 | Walker . |
| 3,067,822 | 12/1962 | Hattenhauer . |
| 3,220,791 | 11/1965 | Pokryfke et al. . |
| 3,722,733 | 3/1973 | Neumann . |
| 3,989,329 | 11/1976 | Benford . |
| 4,034,697 | 7/1977 | Russell . |
| 4,046,439 | 9/1977 | Lee . |
| 4,272,137 | 6/1981 | Rothhass et al. . |
| 4,449,588 | 5/1984 | Benlolo et al. . |
| 4,763,732 | 8/1988 | Neal . |
| 5,171,079 | 12/1992 | Bayerle . |

*Primary Examiner*—Gary C. Hoge

*Attorney, Agent, or Firm*—Schroeder & Siegfried, P.A.

[57] ABSTRACT

A simple and inexpensive, but highly effective, single-walled fire-rated enclosure for a fire extinguisher cabinet which maintains the integrity of 1- and 2-hour fire-rated walls. The enclosure requires only five panels of fire-rated material which are firmly secured in place around the cabinet by a single pair of identically constructed metal mounting brackets which are oppositely secured to opposed walls of the fire extinguisher cabinet. Each bracket is generally planar, but has peripheral portions formed into a pair of oppositely facing channels offset from its outwardly facing surface, a flange extending from the bottom of each channel and away from the inwardly facing surface of the bracket, and a retaining element at one of its sides which also extends away from said inwardly facing surface. Each of the above elements is integrally formed with the more central portions of the bracket.

20 Claims, 2 Drawing Sheets

14
16
51
55
18
38
12
23
15
24
56
17
52
13
46
14
16
21
11
22
12
27
34
48
35
36
15
51
31
38
19
52
32
37
26
28
10
53
33
55
45
47
13
43
49
40
46
20
17
56
41
44
50
42
54

FIRE EXTINGUISHER CABINET MOUNTING

BACKGROUND OF THE INVENTION

The need for fire-rated walls has long been recognized. Such a wall is of substantially diminished value for fire prevention and control, if its integrity is destroyed by the mountings for fire extinguishers or in any other manner. As a consequence, fire control officials have long been in search for a fire-rated fire-extinguisher cabinet.

There have been fire-rated fire-extinguisher cabinets on the market only in very recent years. These cabinets, however, have all utilized a double-walled cabinet with the insulation disposed between their inner and outer walls. Such a structure is relatively expensive to manufacture, because of its double walls and is considerably heavier than our cabinet, thus requiring more material and being more expensive to ship to the purchaser's location. In addition, the sheetrock is shipped within the cabinet walls at increased costs, whereas when the cabinet is constructed in accordance with my invention, no sheetrock is shipped, since it is not applied until after the cabinet arrives at the site of its planned use.

BRIEF SUMMARY OF THE INVENTION

The invention is comprised of a pair of identically formed metal brackets, each one of which is secured to one of a pair of opposite sides of the fire extinguisher cabinet and is generally planar throughout the major and central portion thereof. Each bracket has, at its opposite ends, a pair of oppositely and inwardly facing channel members which are offset outwardly relative to the outwardly facing surface of the bracket to receive and secure end panels of fire-rated sheetrock therebetween, while covering and insulating the end of the cabinet.

Each of said channel members has a bottom wall from which a flange element extends toward the opposite end of the cabinet and in spaced relation to one sidewall of the cabinet. The two flange elements, so carried by the bottom wall of the channel members, at each sidewall of the cabinet, receive and retain a panel of fire-rated sheetrock therebetween and against a sidewall of the cabinet.

Each of said brackets also has front and rear side portions. The rear side portion extends a short distance rearwardly beyond the back side of the cabinet and terminates in a retaining element which extends normal to the general plane of the bracket and toward the opposite bracket to cooperatively engage and retain a rear panel of sheetrock therebetween and over the back wall of the cabinet. Thus, the entire end, side and rear surfaces are retained in secure insulating relation to the entire side, end, and rear walls of the cabinet, which define a tub-like extinguisher-receiving member. Each of the above sheetrock-securing elements is formed integrally with the central planar portions of the bracket.

A cover member is provided for the otherwise open front side of the tub. This cover member has a corresponding, but slightly smaller, opening which is provided with a hinged door by means of which a fire extinguisher may be inserted into, or removed from, the interior of the tub. The cover member is secured with rivets to the adjacent front edge portions of the end walls of the tub to complete the fire extinguisher cabinet, which requires only one tank.

When constructed as described above, the fire extinguisher cabinet is completely insulated so as to meet UL1479 and is UL classified by Underwriters Laboratories, Inc. As such, it qualifies for use in penetration firestop systems.

BRIEF DESCRIPTION OF THE DRAWINGS

These and other objects and advantages of the invention will more fully appear from the following description, made in connection with the accompanying drawings, wherein like reference characters refer to the same or similar parts throughout the several views, and in which.

DETAILED DESCRIPTION OF THE INVENTION

In considering this invention, it should be remembered that the present disclosure is illustrative only and the scope of the invention should be determined by the appended claims.

Figures 1, 2:
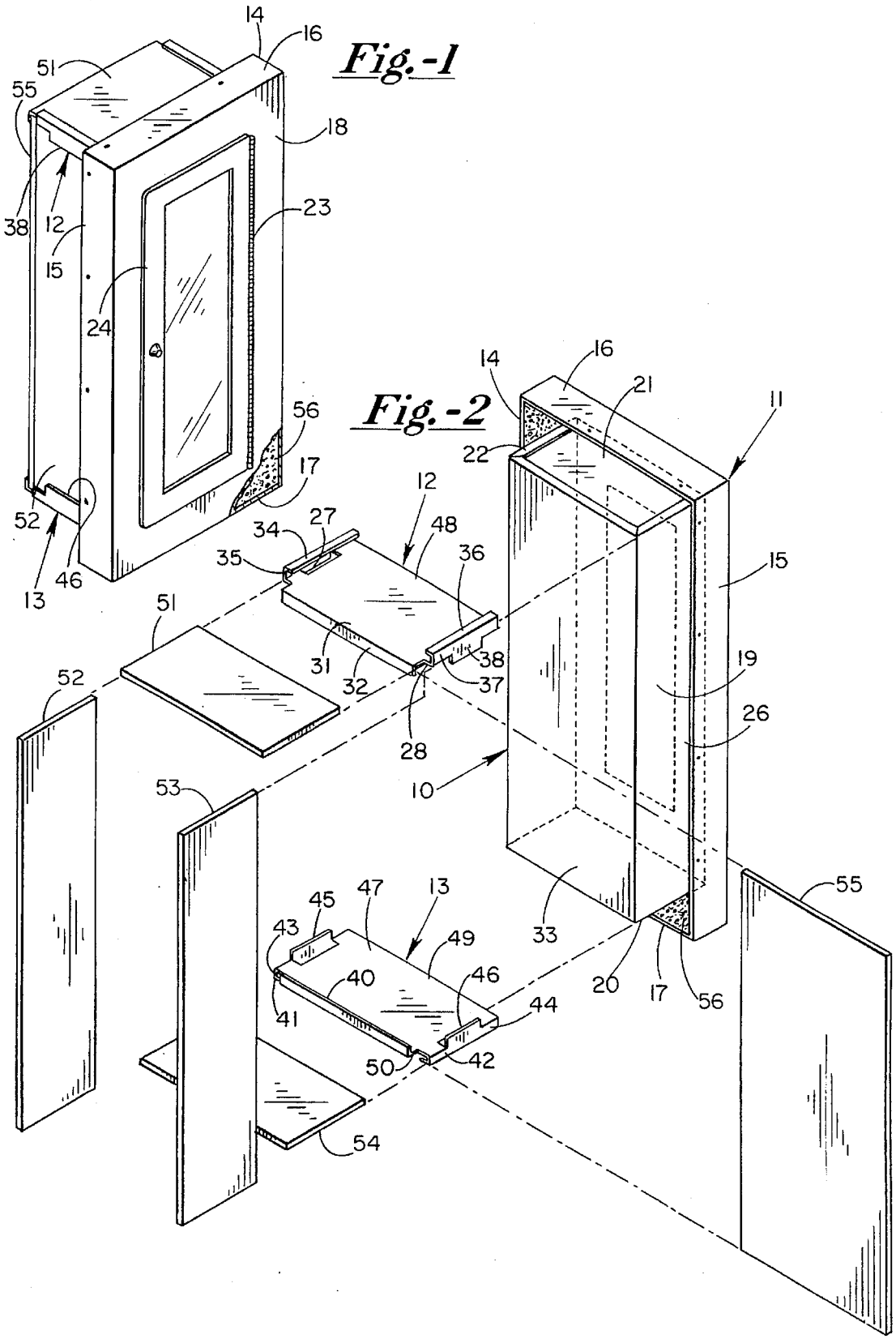
FIG. 1 is a front perspective view of a fire cabinet insulated in accordance with my invention.
FIG. 2 is an exploded view of the cabinet shown in FIG. 1, as viewed from the rear.
Figure 3:
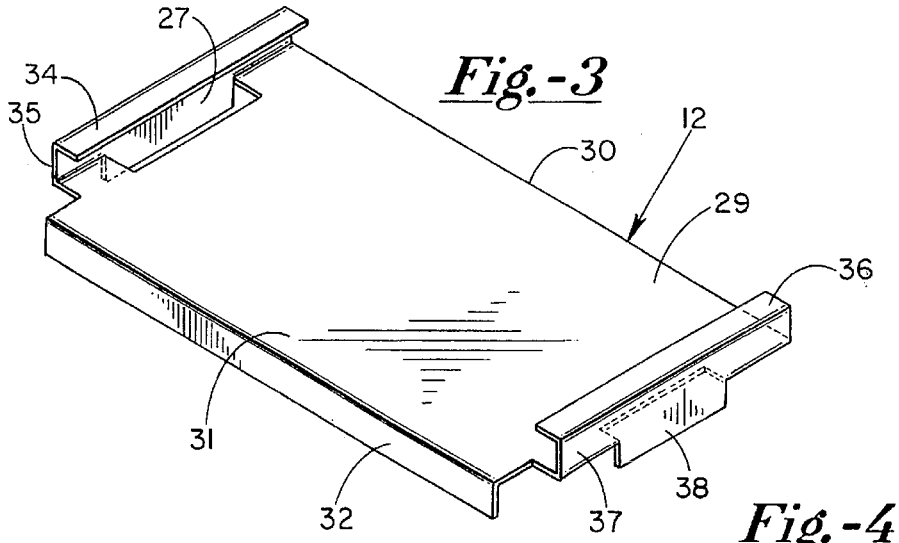
FIG. 3 is a perspective view of the outwardly facing side of the brackets utilized in the invention.
Figure 4:
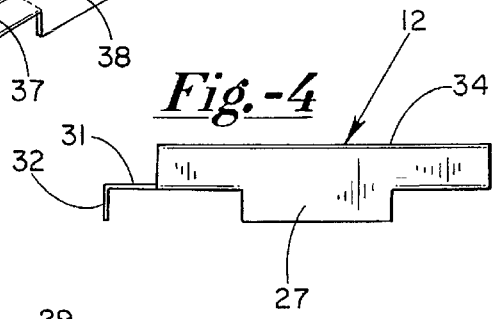
FIG. 4 is an end elevational view of one of said brackets.
Figure 5:
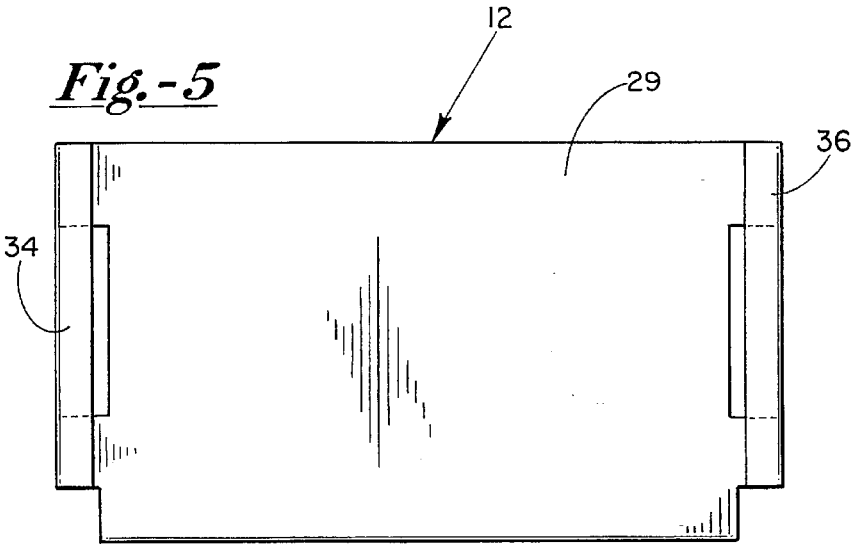
FIG. 5 is a plan view of the outwardly facing side surface of one of said brackets.
Figure 6:
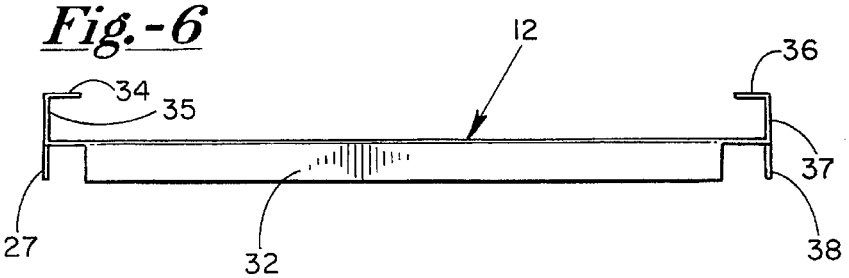
FIG. 6 is a rear elevational view of one of said brackets, oriented as when attached to the top wall of the fire extinguisher cabinet.

The invention includes, as shown in FIGS. 1–6, inclusive, four parts comprised of a tub 10, a cover member 11, and a pair of identically formed brackets 12 and 13. The tub 10 is of generally conventional construction, as is the cover member 11. The latter is sometimes referred to as the trim.

The cover member 11 covers the otherwise open front of the tub 10 to cooperatively form the fire extinguisher cabinet. The cover member, as shown, is comprised of a rectangular pan-like member with outwardly or upstanding sidewalls 14 and 15 and end walls 16 and 17. The dimensions of the bottom of the pan, or front wall 18, are such that the side and end walls are spaced from the side and end walls of the tub 10 approximately 1-¾ inches so as to adequately insulate the cover when mineral wool is placed between the sheetrock which covers the walls of the tub 10 and the walls of the cover member, as is the case when the brackets and sheetrock panels are in place.

The cover member 11 has an opening 19 within the front wall 18 to facilitate introduction of a fire extinguisher into the interior of tub 10. The portions of front wall 18 which define the opening 19 have flanges (not shown) extending inwardly at each side of the opening by means of which the tub 10 is secured to said cover. Thus, the inwardly extending flange at the top of the opening 19 is riveted to the front portions of the top wall 21 of the tub 10. The inwardly extending flange at the right side of the opening 19 is riveted to the side wall 22 of the tub 10 and also to the piano hinges 23 of the door 24.

The inwardly extending flange at the bottom of the opening 19 is riveted to the bottom wall 20 of the tub 10 and the flange at the left side of the opening (when facing the door) is riveted to the sidewall 26 of the tub 10. Thus, the forward edges of the top wall 21, side wall 22, bottom wall 20, and sidewall 26 bear against the inner surface of the cover member 11.

Fixedly secured to the top wall 21 of the tub 10 by means of rivets is one of the thin metal brackets, 12. As shown, the bracket is constructed identically to the oppositely facing bracket 13 which is riveted to the bottom wall 20 and faces in the opposite direction and toward each other. As shown, each of said brackets is generally planar. Thus, bracket 12 has a substantial central area 29 which is planar and has a straight front side 30 and a rearwardly extending side portion 31, which terminates in a downwardly extending retaining element 32, which is disposed approximately ⅝ inch from the rear wall 33 of tub 10. This is the thickness of a panel of fire-rated sheetrock.

The bracket 12 also has opposite end portions which extend outwardly and laterally beyond the ends of retaining element 32. Each of these end portions is formed into an upwardly disposed and oppositely facing channel member, the width of which also is ⅝ inch to receive therein a panel of sheetrock. Thus, channel member 34 faces toward channel member 36 and extends rearwardly from the front edge of the bracket 12 to the back wall 33 of tub 10 and has a bottom wall 35 from which a flange 27 extends downwardly. The flange 27 likewise is disposed ⅝ inch from the sidewall 22 of tub 10.

Channel member 36 is constructed identically to channel member 34, but it faces toward channel member 34 and is directly opposite thereto. It has a bottom wall 37 and a similar flange 38 depending therefrom and extending ⅝ inch from sidewall 26. It will be seen that the front edge of bracket 12 is disposed approximately 1-¼ inches rearwardly of the inner surface of cover member 11.

The bracket 13, which is identical to bracket 12, is riveted to the bottom wall 20 in the same manner, and in the same position relative to the tub 10 except, of course, that the channel members extend downwardly instead of upwardly and its flange elements extend upwardly instead of downwardly and are vertically aligned with the flanges of bracket 12. Likewise, its retaining element extends upwardly toward the retaining element of bracket 12 and is vertically aligned therewith. Thus, bracket 13 has a retaining element 40, channel members 41,42 with bottom walls 43,44, respectively, and flanges 45,46, respectively.

It will be seen that bracket 12 has an inwardly facing surface 28 and an outwardly facing surface 48. Likewise, bracket 13 has an inwardly facing surface 49 and an outwardly facing surface 50.

To complete the enclosure, a rectangular top panel 51 of sheetrock, which is conventionally ⅝ inch thick, is cut with dimensions such as to be received snugly within channel members 34,36 to cover the top wall 21 of the tub 10 and the upper bracket 12 and to extend from the wall 18 to the rear end of said channel members.

In the same manner, side panel 52 of similar sheetrock is cut with dimensions to be snugly received between the channel members 34,41 and within the flanges 27,45 and to extend from the wall 18 to the outer surface of the rear wall 33 of the tub 10. Likewise, a side panel 53 of the same thickness of sheetrock is cut with dimensions to be snugly received between channel members 36,42, at the opposite side of the tub 10 and within the flanges 38,46 and to extend from wall 18 to the outer surface of the rear wall 33 of the tub 10 to cover said wall 26.

A bottom panel 54, of ⅝-inch sheetrock, of the same dimensions as that inserted in bracket 12 is cut and inserted into bottom bracket 13. It, too, extends from the inner surface of the cover 11 only to the outer surface of the rear wall 33 of tub 10 and is snugly received in the channel members 41,42 of that bracket.

Finally, a rear panel 55 of ⅝-inch sheetrock and having a width equal to the width of the rear wall 33 of tub 10, plus 1-¼ inches, is cut and inserted between retaining elements 32,40 and rear wall 33 of tub 10. Thus, panel 55 will overlap the side edges of each of the side panels 52 and 53 to complete the fire-rated enclosure of the cabinet.

As indicated hereinbefore, mineral wool 56 is packed within the one (1) inch spacing which exists between the side and end walls of the cover 11 and the outer surfaces of panels 51–55, inclusive, of sheetrock once they have been installed, as described.

It will be seen that the fire-rated enclosure described hereinabove can be readily provided for any structure similar to the tub 10, to be used as an insulation for any desired purpose. Upon doing so, an excellent fire-rated enclosure therefor will be provided.

To manufacture the brackets described hereinabove, I select thin sheets of commercial grade 18-gauge cold rolled steel. This sheet material is sheared to a specified size to fit the cabinet specified. The steel blanks are processed on a numerically controlled turret punch press in preparation for forming. The forming of the special design is done on a press brake with fitted dies. It takes five (5) strokes of the press to form each bracket. The bracket is then cleaned in a three-step cleaning solution. The final step before assembly is to coat the bracket with a polyester powder and bake same until the powder coating is cured.

It will be seen that the brackets described hereinabove, when properly formed and attached, will firmly hold the fire-rated sheetrock panels in place. Tests show that such an enclosure will maintain the integrity of 1- and 2-hour fire-rated walls with any simple designed UL classified cabinet. It meets UL-1479 and is UL classified by Underwriters Laboratories, Inc., and will be published in the 1996 edition-WL7005 of the UL Fire Resistance Directory.

It will be readily seen that the fire-rated enclosure described above has definite advantages in that it is much less expensive to manufacture, and is substantially lighter in weight, in that it is single-walled, not double-walled, and can be shipped without including the sheetrock which is necessary in any fire-rated cabinet. Moreover, it is easy and simple to assemble and install.

We claim:

1. A fire-rated enclosure for a fire extinguisher cabinet comprising:

(a) a pair of spaced rigid mounting brackets which are of essentially similar construction and are arranged in oppositely facing directions in opposed spaced positions;

(b) each of said brackets being generally planar and having an inwardly and an outwardly facing surface and extending substantially parallel to each other;

(c) each of said brackets having a corresponding side portion extending toward each other which constitutes a retainer element for receiving and cooperatively securing a rear panel of fire-rated sheetrock therebetween;

(d) a rear panel of fire-rated sheetrock extending between said brackets generally normal thereto and retained thereat by said corresponding side portions;

(e) each of said brackets having an oppositely facing channel member associated with said retainer element and extending outwardly from its said outwardly facing surface at each of opposite ends of said bracket in juxtaposition for receiving and cooperatively securing a panel of fire-rated sheetrock therebetween, each of said channel members having a bottom wall;

(f) a pair of panels of fire-rated sheetrock, each of which has ends disposed within the said channel members of one of said mounting brackets and extends therebetween and covers said outwardly facing surface of said bracket;

(g) a plurality of pairs of oppositely disposed flange elements, one of which is carried at the bottom wall of each of said channel members on each of said brackets and extends generally normal to and away from said inwardly facing surface; and (h) a second pair of panels of fire-rated sheetrock, each of which is retained at each of its ends by one of said oppositely disposed flange elements of one of said brackets and extends between said mounting brackets, to collectively constitute, with said brackets and said other panels, a rectangular fire-rated enclosure for a fire extinguisher cabinet.

2. The fire-rated enclosure defined in claim 1, wherein (i) each of said channel members, said flange elements, and said retainer elements are formed integrally with the remainder of one of said mounting brackets.

3. The fire-rated enclosure defined in claim 1, wherein each of said mounting brackets is formed from a single, flat, thin sheet of metal.

4. The fire-rated enclosure defined in claim 1, wherein each of said mounting brackets and its channel members are formed from a single sheet of flat, thin metal, and each of said channel members has opposed side walls, and each of said flange elements is formed from a portion of one of said side walls.

5. The fire-rated enclosure defined in claim 1, wherein each of said channel members of each of said brackets is disposed outwardly of its associated retainer element.

6. The fire-rated enclosure defined in claim 1, wherein said retainer elements of each of said brackets is disposed laterally outwardly of each of its associated channel members.

7. A single-walled, fire-rated, fire extinguisher cabinet comprising:

(a) an upright, metal tub member adapted to receive a fire extinguisher within the confines thereof and having a fire extinguisher-receiving opening at the front thereof;

(b) said upright tub member having generally horizontal top and bottom walls, an upright rear wall, and a pair of upright opposite side walls, said walls collectively defining said opening;

(c) a metal cover member secured to said tub member and extending over said opening;

(d) said cover member having a front panel extending across said opening and having rearwardly extending top, bottom, and side panels extending rearwardly from said front panel and around the walls of said tub member in spaced relation thereto;

(e) said cover member having a central opening within its said front panel which communicates with said opening of said tub member;

(f) a door member hingedly mounted on one of said members and being swingable between open and closed positions relative to said openings;

(g) a generally planar mounting bracket secured to said top wall of said tub member and extending rearwardly beyond said rear wall and terminating in a depending retaining element to thereby cooperatively define a fire-rated sheetrock rear panel-receiving channel with said rear wall of said tub member;

(h) said mounting bracket having opposite end portions, each disposed adjacent one of said sidewalls of said tub member and terminating in an upwardly disposed, inwardly and oppositely facing channel member;

(i) each of said channel members having a bottom channel wall and a flange depending from said bottom channel wall and extending in spaced relation to the adjacent side wall of said tub member to thereby cooperatively define a fire-rated sheetrock side-panel-receiving channel with its adjacent side wall of said tub member;

(j) a second generally planar mounting bracket secured to said bottom wall of said tub member and extending rearwardly beyond said rear wall and terminating in an upwardly extending retaining element to thereby cooperatively define a fire-rated sheetrock rear panel-receiving channel with the lower portion of said rear wall of said tub member;

(k) a rear panel of fire-rated sheetrock disposed within and secured in position by said rear panel-receiving retaining elements of said mounting brackets and covering said rear wall of said tub member;

(l) said second mounting bracket having opposite end portions each of which is disposed adjacent one of said sidewalls and terminates in a downwardly disposed, inwardly and oppositely facing channel member;

(m) each of said downwardly disposed channel members having a bottom channel wall and a flange element extending upwardly from said bottom channel wall and extending in spaced relation to the adjacent side wall of said tub member to thereby cooperatively define a fire-rated sheetrock side panel-receiving channel with its adjacent sidewall of said tub member;

(n) a bottom panel of fire-rated sheetrock disposed within said downwardly disposed, inwardly facing, channel members of said second mounting bracket and covering said bottom wall of said tub member;

(o) a top panel of fire-rated sheetrock disposed within said upwardly disposed, inwardly facing, channel members of said first-mentioned mounting bracket, and covering said top wall of said tub member;

(p) a side panel of fire-rated sheetrock disposed between one of said sidewalls and the said flange elements of the adjacent and corresponding end portions of said brackets and covering said sidewall;

(q) a second side panel of fire-rated sheet-rock disposed between the other of said sidewalls and the said flange elements of the adjacent and corresponding end portions of said brackets and covering said other sidewall, to thereby cooperatively define a fire-rated fire extinguisher cabinet; and (r) each of said fire-rated sheetrock panels being disposed inwardly of said rearwardly extending walls of said cover member a distance sufficient to preclude the transmission of enough heat to said brackets to constitute a fire hazard.

8. The fire extinguisher cabinet defined in claim 7, wherein said bottom channel wall of each of said channel members is upright.

9. The fire extinguisher cabinet defined in claim 7, wherein said bottom channel wall of each of said channel members is upright and said flange depending therefrom extends toward the opposite mounting bracket from a medial portion of said bottom wall.

10. The fire extinguisher cabinet defined in claim 7, wherein said channel members, flange elements, and flanges are disposed in substantial spaced relation relative to said side, top and bottom walls of said cover member.

11. The fire extinguisher cabinet defined in claim 7, wherein said upright tub member is substantially spaced from said side, top and bottom walls of said cover member.

12. A mounting bracket for cooperatively attaching fire-rated sheetrock in insulating relation to the exterior surface of a fire-extinguisher cabinet, comprising:

(a) a thin, generally planar and generally rectangular sheet of metal having opposite inwardly and outwardly facing surfaces and opposite end portions and forward and rear side portions, each of said surfaces being generally planar, said rear side portion of said sheet having an elongated retaining element extending generally normal to the plane of said sheet from said inwardly facing surface;

(b) each of said end portions of said sheet being formed into an opposite channel member facing toward its opposite end portion and disposed laterally of the general plane of said sheet at the outwardly facing surface thereof;

(c) said channel members each having a bottom wall; and (d) each of said channel members having a flange adjacent said bottom wall extending generally normal to and away from the plane of said sheet in the same direction as that in which said retaining element extends.

13. The mounting bracket defined in claim 12, wherein said flange is supported by its adjacent bottom wall.

14. The mounting bracket defined in claim 12, wherein said retaining element is disposed rearwardly of said channel members.

15. The mounting bracket defined in claim 12, wherein said channel members are disposed longitudinally outwardly of said retaining element.

16. The mounting bracket defined in claim 12, wherein said flange extends away from and parallel to its associated bottom wall.

17. The mounting bracket defined in claim 12, wherein each of said channel members has opposite side walls and each of said flanges is formed from a portion of one of said side walls.

18. The mounting bracket defined in claim 12, wherein said bottom wall and said flange of each of said brackets extends in the same general plane.

19. The mounting bracket defined in claim 12, wherein each of said channel members terminates forwardly of said retaining element.

20. The mounting bracket defined in claim 12, wherein each of said channel members terminates abreast of the forward side portion of said sheet.

* * * * *